United States Patent [19]

Juergens

[11] Patent Number: 5,027,912

[45] Date of Patent: Jul. 2, 1991

[54] DRILL BIT HAVING IMPROVED CUTTER CONFIGURATION

[75] Inventor: Rainer Juergens, Celle, Fed. Rep. of Germany

[73] Assignee: Baker Hughes Incorporated, Houston, Tex.

[21] Appl. No.: 504,045

[22] Filed: Apr. 3, 1990

Related U.S. Application Data

[63] Continuation of Ser. No. 215,499, Jul. 6, 1988, abandoned.

[51] Int. Cl.[5] ..... E21B 10/46

[52] U.S. Cl. ..... 175/329; 175/410

[58] Field of Search ..... 175/329, 330, 410, 379, 175/374; 51/295, 309; 408/145; 407/119

[56] References Cited

U.S. PATENT DOCUMENTS

| | | | |
|---|---|---|---|
| 4,478,298 | 10/1984 | Hake et al. | 175/329 |
| 4,592,433 | 6/1986 | Dennis | 175/410 X |
| 4,606,418 | 8/1986 | Thompson | 175/329 |
| 4,624,830 | 11/1986 | Barr | 175/329 X |
| 4,726,718 | 2/1988 | Meskin et al. | 175/329 X |

FOREIGN PATENT DOCUMENTS

| | | | |
|---|---|---|---|
| 86086 | 8/1983 | European Pat. Off. | 175/330 |
| 1122021 | 1/1962 | Fed. Rep. of Germany | 175/379 |
| 1086110 | 4/1984 | U.S.S.R. | 175/329 |
| 980799 | 1/1965 | United Kingdom | 175/329 |
| 2095142 | 9/1982 | United Kingdom | 51/295 |
| 2190412 | 11/1987 | United Kingdom | 175/329 |

*Primary Examiner*—Hoang C. Dang

*Attorney, Agent, or Firm*—Joseph A. Walkowski; Michael Polacek

[57] ABSTRACT

Drill bits may include cutting members which have cutting faces formed of segments of differing cutting materials. The faces of the cutting members may include two or more segments, with the segments formed from at least two different materials. For example, a first segment could be formed of a polycrystalline diamond compact surface while a second segment could be formed of a thermally stable diamond product material.

12 Claims, 1 Drawing Sheet

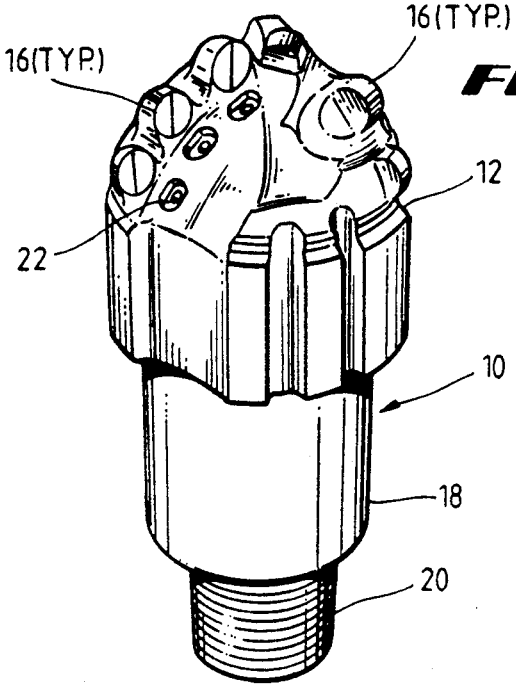
FIG.1
FIG.2
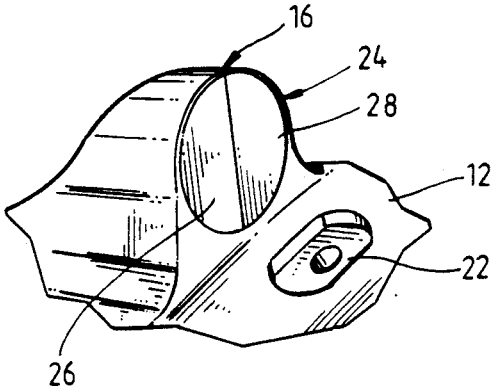
FIG.3A
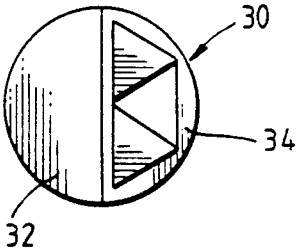
FIG.3B
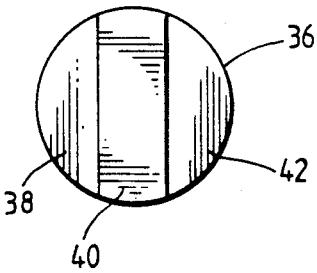
FIG.3C
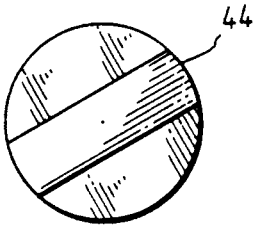
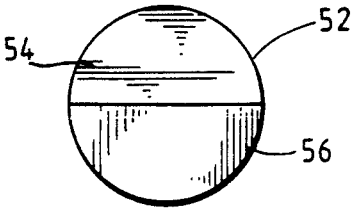
FIG.3D
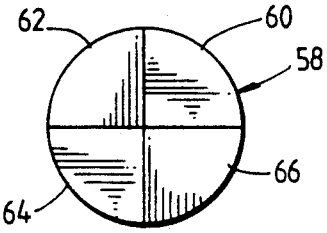
FIG.3E
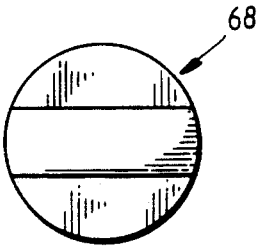
FIG.3F

DRILL BIT HAVING IMPROVED CUTTER CONFIGURATION

This application is a continuation of copending application Ser. No. 07/215,499, filed July 6, 1988, now abandoned.

BACKGROUND OF THE INVENTION

The present invention relates generally to drill bits, and, more specifically, relates to drill bits having improved cutter configurations.

Drill bits presently known to the industry which utilize stationary cutting members typically use either natural or synthetic diamonds as cutting elements, and are conventionally known as "diamond bits". References herein to "diamond bits" or "diamond drill bits" refer to all bits, for either drilling or coring, having primarily stationary cutting members. Conventional diamond drill bits may have a variety of different types of cutting surfaces, such as, for example polycrystalline diamond compact (PDC) cutters, thermally stable diamond product (TSP) cutters, mosaic-type cutters and diamond impregnated stud cutters. Mosaic cutters are typically formed of a plurality of geometrically-shaped thermally stable diamond elements cooperatively arranged and bonded in a desired shape, to form a unitary cutting surface.

On conventional bits, the diamond cutting surface is typically bonded to a supporting member, which is then secured to a carrier member which facilitates attachment to the drill bit. The cutting surface layer is preferably connected to the supporting member such as through use of brazing or sintering. Preferably, the supporting member and the carrier member will both be formed of a suitable hard or sintered metal, such as, for example, tungsten carbide. The supporting member can be soldered or otherwise connected, such as by form sintering or hot isostatic pressing, to the carrier member. A discussion of such a conventional structure is found in U.S. Pat. No. 4,498,549 issued Feb. 12, 1985 to the inventor of the present application, and assigned to the assignee of the present invention. The specification of U.S. Pat. No. 4,498,549 is hereby incorporated herein for all purposes.

Additionally, drill bits may include more than one type of cutting member on a single bit. Some types of cutting surfaces are better adapted to cut specific formations than are others. For example, while large PDC-type cutters are extremely efficient at cutting shales and other similarly soft formations, they are quickly broken or abraded in hard formations. Other cutting surfaces, however, such as mosaic surfaces, will cut through the harder formations satisfactorily. Accordingly, some relatively recent diamond drill bit designs have included dual sets of cutting members, with each set composed of cutting members having different types of cutting surfaces. With bits of that type, for example, a first set of cutters is arranged on the bit to provide essentially full face coverage across the face of the bit, and a second set of cutters, of a different type, is arranged to provide coverage across at least a portion of the bit face. An example of a bit of this type is disclosed in U.S. Pat. application Ser. No. 173,943 filed Mar. 28, 1988, in the names of Mark Jones and Mark Clench, and assigned to the assignee of the present invention.

Such bits with dual cutter sets, while performing exceptionally well in some applications, may not be feasible for use with all types of bits. For example, with bits having cutting members with large cutting surfaces, such as one inch or greater in diameter, it may not be feasible to include two sets of cutters on a single bit. Additionally, even if the additional cutter set could be included on a single bit, the extra surface area could interfere with chip removal, or could raise the total bottom hole surface area contacting the formation to a level which would require an unacceptably high weight-on-bit to cut the formation.

Accordingly, the present invention provides a new method and apparatus for including composite cutting surfaces on a single drill bit, whereby the exposed face of the cutting member may be maintained at a desired size, but whereby that face can be composed of different cutting surfaces adapted to perform differently in the earth formations.

SUMMARY OF THE INVENTION

Drill bits in accordance with the present invention include at least some cutting members which include cutting faces with multiple segments of cutting materials. Each cutting member in accordance with the present invention will include at least two segments, which are formed of at least two materials. The cutting material segments will have exposed faces which cooperatively form the cutting face of the cutting member. The segment faces will preferably lie in generally parallel planes, and most preferably will be generally coplanar.

BRIEF DESCRIPTION OF THE DRAWINGS

FIG. 1 depicts a diamond drill bit having cutting members in accordance with the present invention.

FIG. 2 depicts that an isolated cutting member of the drill bit of FIG. 1.

FIGS. 3A–3F depict exemplary alternative cutting faces for a cutting member in accordance with the present invention.

DETAILED DESCRIPTION OF THE PREFERRED EMBODIMENT

Referring now to the drawings in more detail, and particularly to FIG. 1, therein is depicted an exemplary embodiment of a drill bit 10 in accordance with the present invention. Drill bit 10 includes a body section 12 which carries a plurality of cutting members 16. Body 12 is preferably a molded component fabricated through conventional metal matrix infiltration technology. Body section 12 is coupled to a shank 18 which includes a threaded portion 20. Shank 18 and body 12 are preferably formed to be functionally integral with one another. Drill bit 10 includes an internal recess (not illustrated), through which hydraulic fluid will flow. A plurality of nozzles 22 are placed in body 12 to distribute hydraulic flow proximate the faces of cutting members 16.

Referring now also to FIG. 2, therein is depicted an exemplary cutting member 16 in greater detail. The cutting face 24 of cutting member 16 includes two segments, 26 and 28. Cutting face segments 26 and 28 will each be formed of a layer of a cutting material, but will be formed of different types of cutting material. For example, segment 26 may be a PDC cutting layer, while segment 28 may be a TSP cutting layer. Cutting face 24 of cutting member 16 may be formed of segments arranged in any of a variety of conformities, and such face segments may be formed of any of a variety suitable materials.

Referring now to FIGS. 3A–3F, therein are depicted exemplary alternative configurations and constructions for the cutting face of a cutting member 16 as depicted in FIGS. 1 and 2. FIG. 3A depicts a cutting face 30 having a PDC face segment 32 and a mosaic face segment 34. The two segments 32 and 34 are symmetrically arranged relative to a vertical axis. FIG. 3B depicts a face segment 36 having three generally vertically extending faces 38, 40 and 42, symmetrically arranged about a central vertical diameter. In the depicted embodiment, outer face segments 38 and 42 are of a first type of cutting surface, while central face segment 40 is of a second type of cutting surface.

FIG. 3C depicts a cutting face 44, which is similar in construction to cutting face 36 of FIG. 3B, with the exception that the face segments, 46, 48 and 50 are symmetrically disposed about a nonvertical diameter. FIG. 3D depicts a two segment cutting face 52, with face segments distributed on either side of a horizontal diameter. Here again, upper segment 54 may be of a material such as a PDC layer, while lower segment 56 may be of a different material, such as a TSP or mosaic material.

FIG. 3E depicts an exemplary embodiment where the cutting face 58 is divided into a plurality of quadrant face segments 60, 62, 64 and 66. These face segments 60, 62, 64 and 66 can be formed, for example, of two alternating cutting layer materials or could all be formed of different cutting layer materials.

FIG. 3F depicts an embodiment similar to that of FIGS. 3B and 3C, with the exception that the three face segments of cutting face 68 are disposed symmetrically relative to a horizontal diametrical axis.

Many modifications and variations may be made in the techniques and structures described and illustrated herein without departing from the spirit and scope of the present invention. For example, the multiple material cutting face segments may be formed of virtually any appropriate material, and may be arranged in a variety of patterns in addition to those described and depicted herein. Accordingly, the techniques and structures described and illustrated herein are exemplary only and are not to be considered as limitations on the scope of the present invention.

What is claimed is:

1. A rotary drill bit for drilling a subterranean formation, comprising:

a body member secured to shank means for rotating said bit about a longitudinal axis;

a plurality of cutting members disposed on said body member, said cutting members each including a cutting face oriented substantially in the direction of bit rotation;

each cutting face having an edge and comprising at least two laterally adjacent segments formed of different diamond cutting materials and oriented on said cutting face so that the edge thereof engaging said formation as said bit is rotated includes sectors of each of said different diamond cutting materials.

2. The drill bit of claim 1, wherein said face segments of said cutting member face lie in generally parallel planes.

3. The drill bit of claim 1, wherein said face segments of each cutting member face are generally coplanar.

4. The drill bit of claim 1, wherein at least one of said face segments if formed of a polycrystalline diamond compact surface.

5. The drill bit of claim 1, wherein at least one of said face segments comprises a thermally stable diamond surface.

6. The drill bit of claim 1, wherein at least one of said face segments if formed of a diamond mosaic surface.

7. A cutting member for a rotary drill bit comprising:

a supporting structure mounted on said drill bit; and a cutting face including a cutting edge disposed on said supporting structure and including at least two laterally adjacent segments formed of different diamond cutting materials and oriented on said cutting face so that said cutting edge thereof includes sectors of each of said different diamond cutting materials.

8. The cutting member of claim 7, wherein said cutting face segments lie in generally parallel planes.

9. The cutting member of claim 7, wherein said cutting face segments are generally coplanar.

10. The cutting member of claim 7, wherein at least one of said segments if formed of a polycrystalline diamond compact surface.

11. The cutting member of claim 7, wherein at least one of said segments if formed of a thermally stable diamond surface.

12. The cutting member of claim 7, wherein at least one of said face segments is formed of a diamond mosaic surface.

* * * * *

UNITED STATES PATENT AND TRADEMARK OFFICE

CERTIFICATE OF CORRECTION

PATENT NO. : 5,027,912

DATED : July 2, 1991

INVENTOR(S) : Rainer Juergens

It is certified that error appears in the above-identified patent and that said Letters Patent is hereby corrected as shown below:

Column 4, lines 19, 25, 40 and 43, the word "if" should read --is--.

Signed and Sealed this

Thirteenth Day of October, 1992

*Attest:*

DOUGLAS B. COMER

*Attesting Officer*

*Acting Commissioner of Patents and Trademarks*